US010865542B2

(12) United States Patent
Smith et al.

(10) Patent No.: US 10,865,542 B2
(45) Date of Patent: Dec. 15, 2020

(54) GRADING CONTROL SYSTEM USING MACHINE LINKAGES

(71) Applicant: CATERPILLAR INC., Peoria, IL (US)

(72) Inventors: Sage Smith, Apex, NC (US); Christopher Mark Elliott, Apex, NC (US); Jeremy A. Kushner, Raleigh, NC (US)

(73) Assignee: Caterpillar Inc., Peoria, IL (US)

( * ) Notice: Subject to any disclaimer, the term of this patent is extended or adjusted under 35 U.S.C. 154(b) by 406 days.

(21) Appl. No.: 15/879,722

(22) Filed: Jan. 25, 2018

(65) Prior Publication Data

US 2019/0226176 A1 Jul. 25, 2019

(51) Int. Cl.

| | |
|---|---|
| ***E02F 3/76*** | (2006.01) |
| ***E02F 3/84*** | (2006.01) |
| ***E02F 3/43*** | (2006.01) |

(52) U.S. Cl.

CPC ..... *E02F 3/845* (2013.01); *E02F 3/432* (2013.01); *E02F 3/841* (2013.01)

(58) Field of Classification Search

CPC ..... E02F 3/845; E02F 3/7618; E02F 3/841; E02F 3/432; E02F 3/842; E02F 8/847; E02F 3/844; E02F 3/7631; E02F 3/7627; E02F 9/265

USPC ..... 37/347, 348; 172/2–11; 701/24, 50

See application file for complete search history.

(56) References Cited

U.S. PATENT DOCUMENTS

| | | | | |
|---|---|---|---|---|
| 5,052,883 | A | 10/1991 | Morita et al. | |
| 5,356,260 | A | 10/1994 | Ikari et al. | |
| 5,467,829 | A | 11/1995 | Barton et al. | |
| 7,222,444 | B2 | 5/2007 | Hendron et al. | |
| 7,293,376 | B2 | 11/2007 | Glover | |
| 8,103,417 | B2 * | 1/2012 | Gharsalli | E02F 3/844 318/587 |
| 8,548,690 | B2 * | 10/2013 | Hayashi | E02F 3/847 172/4.5 |
| 9,328,479 | B1 | 5/2016 | Rausch et al. | |
| 9,624,643 | B2 * | 4/2017 | Hendron | E02F 3/847 |
| 9,752,300 | B2 * | 9/2017 | Chang | E02F 3/844 |
| 2002/0162668 | A1 * | 11/2002 | Carlson | E02F 3/847 172/4.5 |

(Continued)

FOREIGN PATENT DOCUMENTS

| | | |
|---|---|---|
| CA | 2 885 399 | 9/2016 |
| JP | 59-154234 | 9/1984 |

*Primary Examiner* — Robert E Pezzuto

(74) *Attorney, Agent, or Firm* — Finnegan, Henderson, Farabow, Garrett & Dunner, LLP

(57) ABSTRACT

A grading control system may have a lift actuator to raise or lower a work implement, and a tilt actuator to tilt the work implement. The grading control system may also have a first sensor that communicates a signal indicative of a position of the work implement, and a second sensor that communicates a signal indicative of a position of the machine frame. The grading control system may have a controller to determine a track plane of the machine and a desired grade relative to the track plane. Further, the controller may determine an orientation of the work implement relative to the track plane to maintain the desired grade based on the sensor signals. The controller may also be configured to actuate one or both of the lift and the tilt actuators to orient the work implement according to the determined orientation.

20 Claims, 6 Drawing Sheets

(56) References Cited

U.S. PATENT DOCUMENTS

| | | | |
|---|---|---|---|
| 2011/0153170 | A1 | 6/2011 | Dishman et al. |
| 2011/0213529 | A1 | 9/2011 | Krause et al. |

* cited by examiner

GRADING CONTROL SYSTEM USING MACHINE LINKAGES

TECHNICAL FIELD

The present disclosure relates generally to a grading control system and more particularly, to a grading control system using machine linkages.

BACKGROUND

Preparation of a worksite often includes grading a worksite using a machine to form a ground surface having a desired grade. Grading a worksite may include preparing the ground surface to have a desired slope in a direction of travel of the machine and/or a cross-slope in a direction generally perpendicular to the direction of travel of the machine. Conventional methods of grading may include placing multiple grading stakes about the worksite as reference points. The orientation of a work implement of the machine may be adjusted based on the grading stakes to ensure that the correct amount of material is removed or added to form the desired grade. The orientation of the work implement may be controlled manually.

The accuracy of the grade, however, depends on the number of grade stakes used, the distance between the stakes, and the ability of the operator of the machine to correctly orient the work implement to achieve the desired grade. To minimize error, surveyors may have to place the stakes closer together, which may make stake placement a lengthy and tedious process. Furthermore, the machine may simultaneously pitch fore/aft and side to side during the grading operations as the machine tracks or wheels follow the uneven ground surface. An operator must, therefore, react quickly and accurately to accurately achieve the desired grade while also moving fast enough to be productive.

Some techniques for grading employ the use of automatic control systems coupled with sensors that communicate with external references that identify the desired grade. For example, U.S. Pat. No. 7,293,376 B2 of Glover issued on Nov. 13, 2007 ("the '376 patent") and discloses a grading control system for a work machine having a work implement for grading along a grade defined by a laser plane generator. The '376 patent discloses a laser receiver attached to the work machine and configured to receive a laser signal indicative of a desired grade. The '376 patent further discloses lift sensor configured to communicate a lift signal indicative of a lift position of the work implement. The '376 patent also discloses a control module configured to generate and communicate control signals to actuate at least one of the lift and tilt actuators to maintain the work implement at a position substantially corresponding to the desired grade.

Although the '376 patent discloses an automated control system for grade control, the system of the '376 patent requires a laser receiver and a laser plane generator. Such laser equipment may be prone to damage during operations on a work site due to interaction with the work machines or materials at the work site. The need for laser receivers and the laser plane generator may also make the system of the '376 patent more expensive. Moreover, the laser receiver of the '376 patent may not be able to determine the desired grade without an unobstructed line of sight view of the laser plane. In addition, the system of the '376 patent still requires a separate hydro-mechanical system on the machine to keep the work tool on grade.

The grading control system of the present disclosure solves one or more of the problems set forth above and/or other problems of the prior art.

SUMMARY

In one aspect, the present disclosure is directed to a grading control system. The grading control system may include a lift actuator configured to selectively raise and lower the work implement. The grading control system may further include a tilt actuator configured to tilt a work implement of the machine. The grading control system may also include a first sensor configured to communicate a first signal indicative of a first position of the work implement relative to at least one of a machine frame or a gravity vector. Additionally, the grading control system may include a second sensor configured to communicate a second signal indicative of a second position of the machine frame relative to the gravity vector. The grading control system may include a controller in communication with the first and second sensors. The controller may be configured to determine a track plane defined by an undercarriage of the machine. The controller may also be configured to determine a desired grade relative to the track plane. Further, the controller may be configured to determine an orientation of the work implement relative to the track plane required to maintain the desired grade based on at least one of the first and second signals. The controller may also be configured to generate at least one control signal to actuate at least one of the lift actuator and the tilt actuator to orient the work implement based on the determined orientation.

In another aspect, the present disclosure is directed to a grading control method. The method may include receiving at least one input indicative of a desired grade. The method may also include generating a track plane associated with a machine. Further, the method may include determining, using a controller, the desired grade relative to the track plane of the machine based on the at least one input. The method may include propelling the machine on a ground surface. The method may also include determining, using the controller, an orientation of the work implement relative to the track plane required to maintain the desired grade as the machine is propelled on the ground surface. The method may include generating, using the controller, at least one control signal to actuate at least one of a lift actuator and a tilt actuator of the machine based on the determined orientation. In addition, the method may include actuating at least one of the lift actuator and the tilt actuator based on the at least one control signal to orient the work implement.

In yet another aspect the present disclosure is directed to a machine. The machine may include a machine frame and a plurality of traveling devices configured to support the machine frame over a ground surface. The machine may also include a work implement. The machine may include a lift arm pivotably connected to the machine frame and to the work implement. The machine may include a lift actuator configured to selectively raise and lower the work implement relative to the machine frame. The machine may also include a tilt actuator configured to tilt the work implement relative to the lift arm. Further, the machine may include a first sensor configured to communicate a first signal indicative of a first position of the work implement relative to at least one of the lift arm, the machine frame, or a gravity vector. The machine may also include a second sensor configured to communicate a second signal indicative of a second position of the machine frame relative to the gravity vector. In addition, the machine may include a controller in communication with the first and second sensors and with the lift and tilt actuators. The controller may be configured to determine a desired grade relative to a track plane associated with the travelling devices of the machine. Further, the controller may be configured to determine an orientation of the work implement relative to the track plane to maintain the desired grade based on at least one of the first and second signals. The controller may also be configured to generate at least one control signal to orient the work implement based on the determined orientation. In addition, the controller may be configured to actuate at least one of the lift actuator and the tilt actuator based on the at least one control signal.

DETAILED DESCRIPTION

Figure 1:
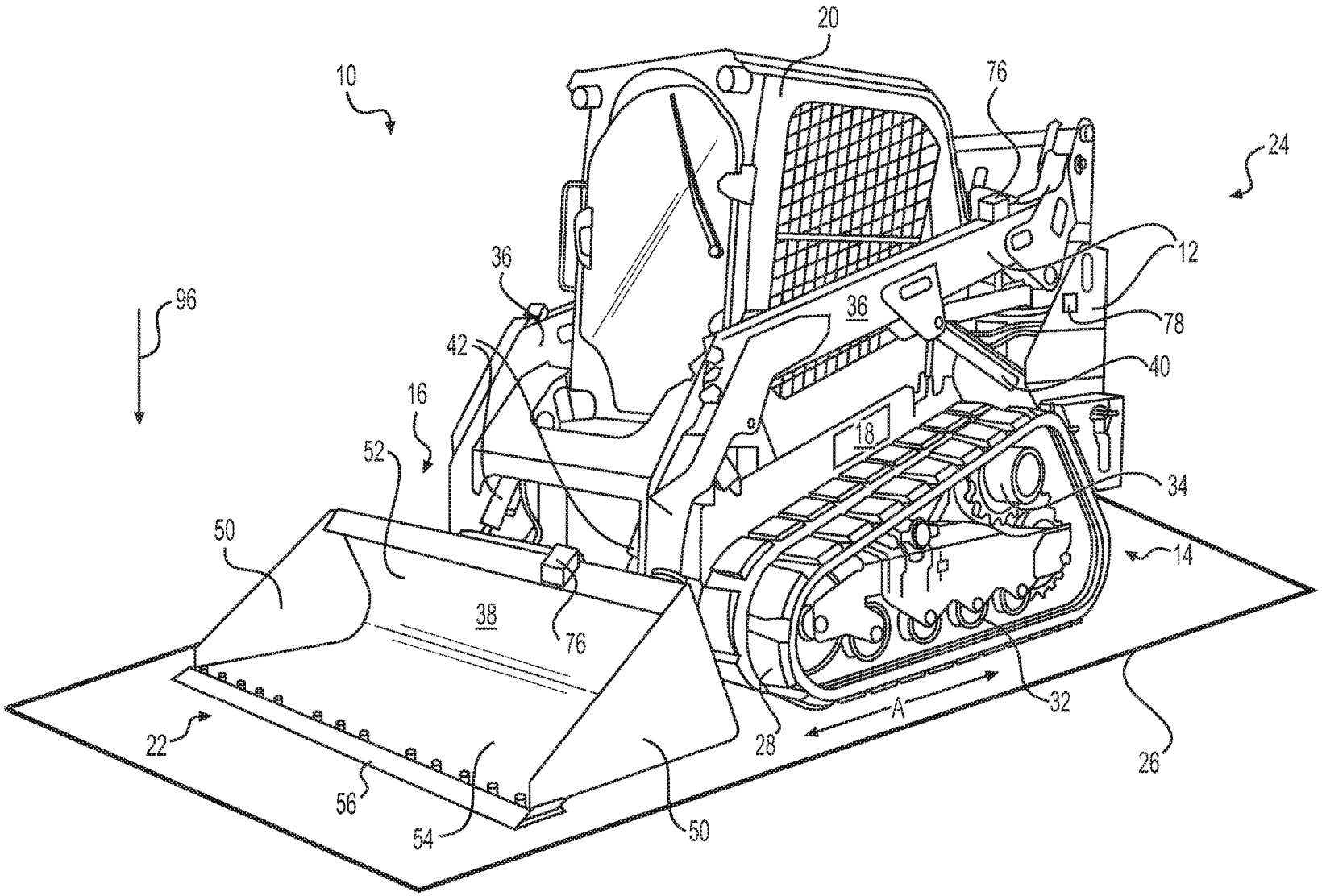
FIG. 1 is a pictorial illustration of an exemplary disclosed machine.

FIG. 1 illustrates an exemplary embodiment of a machine 10 that may be used for grading a worksite. Machine 10 may perform some type of earth moving, excavation, or other operation associated with an industry such as construction, mining, or another industry known in the art. For example, as illustrated in FIG. 1, machine 10 may be a compact track loader. It is contemplated however that machine 10 may be, for example, a motor grader, a wheel loader, a dozer, or another machine that may be used for grading a worksite. Machine 10 may include machine frame 12, undercarriage 14, work tool assembly 16, engine 18, and operator station 20. It is contemplated that machine 10 may be an autonomous machine, which can be operator without the need for an operator to be present on machine 10. It is also contemplated that machine 10 may be remotely controllable by an operator located off board machine 10.

Machine frame 12 may extend from front end 22 to rear end 24 of machine 10. Machine frame 12 may be supported on ground surface 26 by undercarriage 14, which may be used to propel machine 10 in a forward or rearward direction (i.e. along arrow A). In some exemplary embodiments, a suspension system (not shown) may be disposed between machine frame 12 and undercarriage 14. The suspension system may include for example, one or more of springs, dampers, shock absorbers, and/or other suspension components known in the art. Undercarriage 14 may be configured to engage ground surface 26, roads, and/or other types of terrain. Undercarriage 14 may include, a pair of endless tracks 28 and 30 (see FIG. 2B, 3) that may be supported by one or more rollers 32. Undercarriage 14 may also include sprockets 34 that may be driven by engine 18. Rotation of sprockets 34 may cause tracks 28 and 30 to propel machine 10 in the forward or rearward direction. Although, machine 10 in FIG. 1 has been illustrated as having left and right tracks 28 and 30, it is contemplated that undercarriage 14 of machine 10 may instead include a plurality of wheels for propelling machine 10 in a forward or rearward direction. For example, undercarriage 14 of machine 10 may include a pair of front wheels (not shown) disposed adjacent front end 22 of machine frame 12, and a pair of rear wheels (not shown) disposed adjacent rear end 24 of machine frame 12.

Work tool assembly 16 of machine 10 may be connected to and may be supported by machine frame 12. In one exemplary embodiment as illustrated in FIG. 1, work tool assembly 16 may include at least lift arms 36, work implement 38, lift actuators 40, and tilt actuators 42. Lift arms 36 may be pivotably connected to machine frame 12 at loader joints 46 adjacent rear end 24 of machine frame 12. It is contemplated, however, that in some exemplary embodiments, one or more links (not shown) may be disposed between lift arms 36 and machine frame 12, and that the one or more links may connect lift arms 36 to machine frame 12. Lift arms 36 may extend from adjacent rear end 24 toward front end 22 of machine frame 12. Work implement 38 may be pivotably attached to lift arms 36 at tool joints 48 adjacent front end 22. It is contemplated, however, that in some exemplary embodiments, one or more links (not shown) may be disposed between work implement 38 and lift arms 36, and that the one or more links may connect work implement 38 to lift arms 36. Loader joints 46 and tool joints 48 may be pin joints, allowing the respective lift arms 36 and work implement 38 to pivot so that the lift and tilt of the work implement 38 can be controlled. Although two lift arms 36 have been illustrated in FIG. 1, it is contemplated that machine 10 may have any number of lift arms 36.

In one exemplary embodiment as illustrated in FIG. 1, work implement 38 may be a bucket configured to receive, scoop, and/or carry a load, for example, soil, dirt, gravel, etc. Bucket 38 may have side walls 50, back wall 52, bottom wall 54 and edge 56. Bottom wall 54 and back wall 52 of bucket 38 may extend between side walls 50. Bottom wall 54 of bucket 38 may extend from adjacent front end 22 of machine frame 12 towards rear end 24. Edge 56 may be disposed on bottom wall 54 adjacent front end 22. Edge 56 may be configured to engage with ground surface 26 to excavate ground surface 26 during grading operations. In other exemplary embodiments, work implement 38 may be a blade, a shovel, a box blade, or any other type of work implement or tool suitable for use with machine 10.

As also illustrated in FIG. 1, work tool assembly 16 may include lift actuators 40 pivotably connected between machine frame 12 and lift arms 36. Selectively extending or retracting lift actuators 40 may help raise or lower lift arms 36 and consequently raise or lower work implement 38 relative to machine frame 12 and ground surface 26. Work tool assembly 16 may also include tilt actuators 42 pivotably connected between lift arms 36 and work implement 38. Selectively extending or retracting tilt actuators 42 may help rotate work implement 38 relative to lift arms 36. Thus, adjusting lift actuators 40 and/or tilt actuators 42 may change an inclination or angle of attack of edge 56 relative to ground surface 26, which in turn may affect the resulting grade of ground surface 26 as machine 10 is propelled on ground surface 26. Lift actuators 40 and tilt actuators 42 may be hydraulic actuators (e.g. piston-cylinder units). It is contemplated, however, that lift actuators 40 and tilt actuators 42 may be pneumatic actuators or other types of actuators known in the art. Although two lift actuators 40 and two tilt actuators 42 have been illustrated in FIG. 1, it is contemplated that work tool assembly 16 may include any number of lift actuators 40 and tilt actuators 42.

Engine 18 may be supported by machine frame 12 and may be configured to generate a power output that can be directed through sprockets 34 and tracks 28 and 30 to propel machine 10 in a forward or rearward direction (i.e. along an direction between front end 22 and rear end 24). Engine 18 may be any suitable type of internal combustion engine, such as a compression-ignition engine, a spark-ignition engine, a natural gas or alternative fuel engine, or a hybrid-powered engine. It is also contemplated that in some exemplary embodiments engine 18 may be driven by electrical power.

Engine 18 may be configured to deliver power output directly to sprockets 34. Additionally or alternatively, engine 18 may be configured to deliver power output to a generator (not shown), which may in turn drive one or more electric motors (not shown) coupled to sprockets 34. According to yet another embodiment, engine 18 may deliver power output to a hydraulic motor (not shown) fluidly coupled to a hydraulic pump (not shown) and configured to convert a fluid pressurized by the hydraulic pump into a torque output, which may be directed to sprockets 34. In addition to providing power for propelling machine 10, engine 18 may also provide power to move and/or manipulate work tool assembly 16 associated with machine 10. For example, engine 18 may provide power to one or more hydraulic pumps (not shown) that may provide pressurized fluid to one or more of lift actuators 40 and/or tilt actuators 42 to manipulate work implement 38.

Operator station 20 may be supported on machine frame 12. Operator station 20 may be an open or an enclosed compartment. One or more controls may be associated with operator station 20 and may include, for example, one or more input devices for operating and/or driving machine 10. In one exemplary embodiment, the controls in operator station 20 may also include one or more display devices 58 (see FIG. 4) for conveying information to an operator.

Figure 2B:
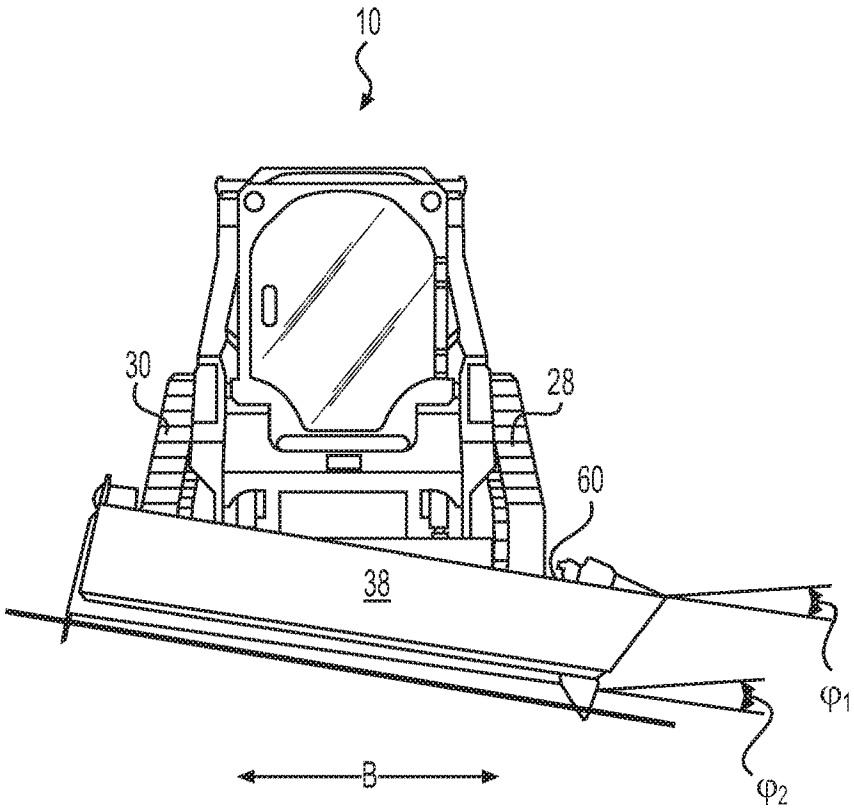
FIG. 2B is a front view illustration of the machine of FIG. 1, illustrating the cross-slope associated with the desired grade.
Figure 2A:
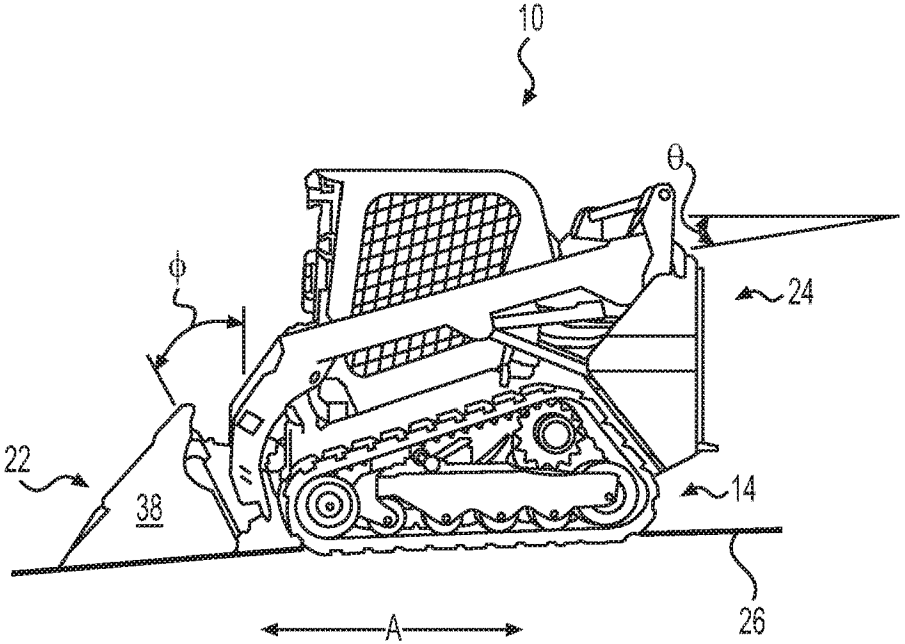
FIG. 2A is a side view illustration of the machine of FIG. 1, showing the mainfall (i.e. fore/aft slope) of a desired grade.

FIG. 2A shows a side-view illustration of machine 10 disposed on ground surface 26. As illustrated in FIG. 2A, undercarriage 14 of machine 10 rests on ground surface 26, and work implement 38 rests on a portion of ground surface 26 at a different grade (e.g. slope). For example, as illustrated in FIG. 2A, work implement 38 rests on the portion of ground surface 26 that is sloped from rear end 24 of machine 10 towards front end 22, which is typically along a travel direction of machine 10. The grade or slope of the ground surface along the travel direction A of machine 10, in the fore/aft direction of machine 10 may be termed "mainfall." FIG. 2B shows a front-view illustration of machine 10 disposed on ground surface 26. As illustrated in FIG. 2B, work implement 38 rests on a portion of ground surface 26 at grade (e.g. slope) from one side of machine 10 to an opposite side of machine 10 (e.g. left to right) in a direction of arrow B disposed generally perpendicular to a travel direction A of machine 10. The grade or slope of the ground surface in a direction generally perpendicular to the travel direction of machine 10 (i.e. from side to side) may be termed "cross-slope." In one exemplary embodiment, a cross-slope of work implement 38 may be defined by an angle "$\varphi_1$" between, for example, an upper edge 60 of work implement 38 and machine frame 12. It is contemplated, however, that the cross-slope may be defined by an angle "$\varphi_2$" between lower edge 62 of work implement 38 and machine frame 12. In some exemplary embodiments, angles $\varphi_1$ and $\varphi_2$ may be defined relative to ground surface 26 or relative to an arbitrary plane that may be inclined or may be generally parallel to ground surface 26.

Figure 3:
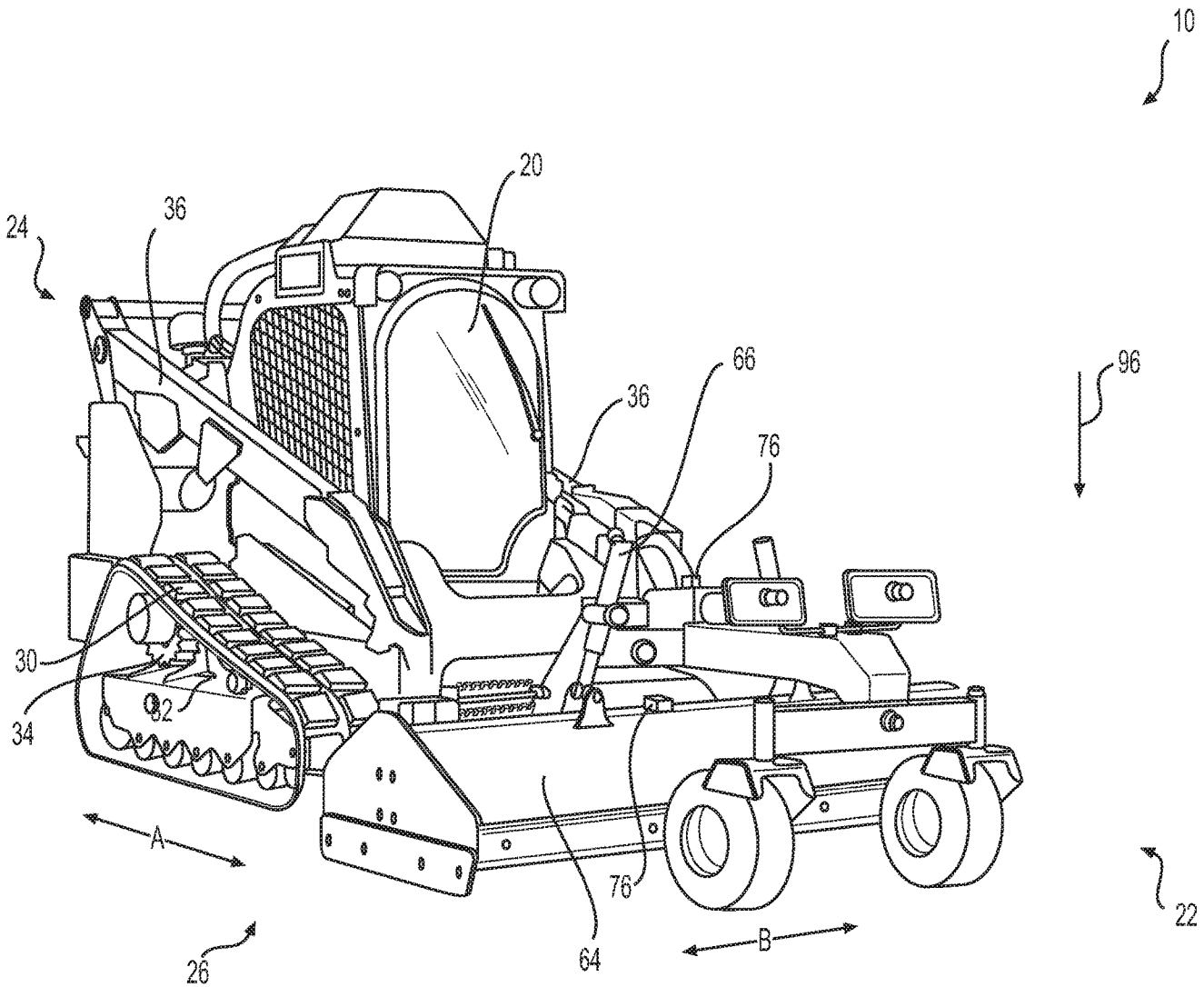
FIG. 3 is a pictorial illustration of another exemplary disclosed machine having a work tool equipped with cross-slope actuators.

FIG. 3 illustrates another exemplary embodiment of machine 10 that may be used for grading a worksite. Machine 10 in FIG. 3 includes many of the features also included in machine 10 illustrated in FIG. 1. Therefore, only the features of machine 10 that are different in FIG. 3 are described next. As illustrated in FIG. 3, machine 10 may include work implement 64, which may be different from work implement 38 illustrated in FIG. 1. For example, work implement 64 may be a blade and may include cross-slope actuators 66. Like lift actuators 40 and tilt actuators 42, cross-slope actuators 66 may be hydraulic actuators, pneumatic actuators, or any other type of actuators known in the art. Selectively extending or retracting one or more of cross-slope actuators 66 may allow work implement 64 to be positioned such that upper edge 60 or lower edge 62 of work implement 64 may be inclined at a cross-slope angle $\varphi_1$ or $\varphi_2$, respectively, relative to machine frame 12, ground surface 26, or an arbitrary plane inclined relative to ground surface 26. Adjusting cross-slope actuators 66 may allow work implement 38 to have a cross-slope in the side-to-side direction B of machine 10, i.e. in a direction generally perpendicular to a travel direction A of machine 10. It is contemplated that machine 10 as illustrated in FIG. 3 may be an autonomous machine, which can be operator without the need for an operator to be present on machine 10. It is also contemplated that machine 10 may be remotely controllable by an operator located off board machine 10.

Figure 4:
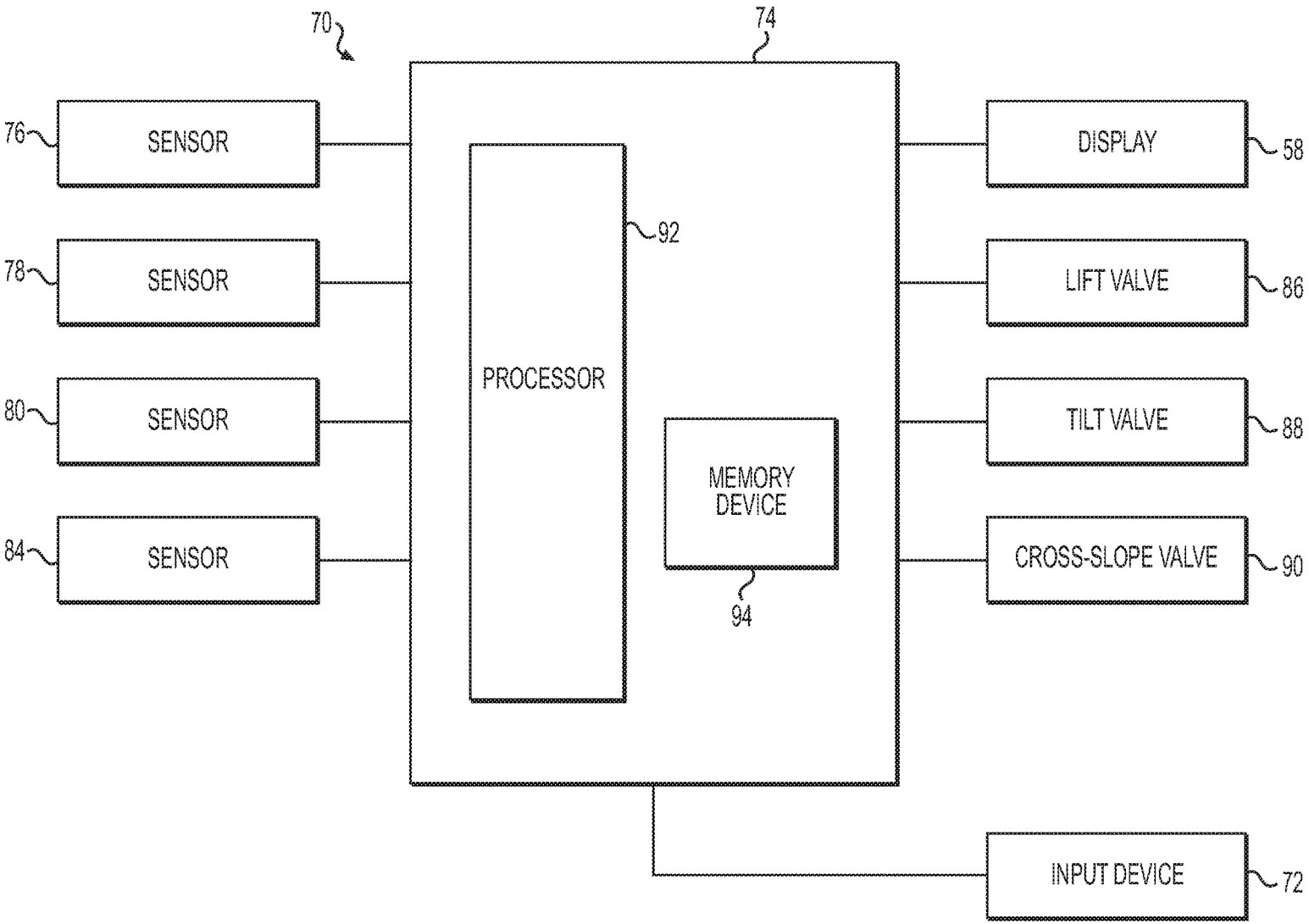
FIG. 4 is a schematic illustration of an exemplary disclosed grade control system that may be used with the machines of FIG. 1 or FIG. 3.

FIG. 4 shows an exemplary grading control system 70 for controlling the orientation of work implement 38 during grading operations performed by machine 10. As described in greater detail below, grading control system 70 may be configured to determine an orientation of work implement 38 and/or move work implement 38 while grading a worksite so that the finished grade may substantially correspond to a desired grade on ground surface 26. Grading control system 70 may include input devices 72, controller 74, display devices 58, one or more sensors 76, 78, 80, 82, that provide measured inputs, and one or more valves 86, 88, 90 that may help control lift actuators 40, tilt actuators 42, and/or cross-slope actuators 66. In some exemplary embodiments, grading control system 70 may be located onboard machine 10, which may be autonomous or remotely controlled. In these exemplary embodiments, grading control system 70 may be configured to adjust the orientation of work implement 38 and/or move work implement 38 while grading a worksite even when machine 10 and/or work implement 38 may not be visible to a remote operator. In other exemplary embodiments, grading control system 70 may be part of an overall machine autonomous control system, which may allow machine 10 to grade a worksite based on predetermined requirements and/or inputs received based on measurements from various sensors associated with machine 10.

Input devices 72 may include one or more of joysticks, keyboards, knobs, levers, touch screens, or other input devices known in the art. Adapted to generate a desired movement signal, input devices 72 may receive one or more inputs from an operator and may communicate the one or more inputs as in the form of one or more signals to controller 74. Input devices 72 may be used to operate or drive machine 10, and may also be used to manually control lift actuators 40, tilt actuators 42, and/or cross-slope actuators 66. Further, input devices 72 may be used to control a speed of machine 10 and/or to steer machine 10 as machine 10 travels over ground surface 26. In addition, input devices 72 may be used to input a desired lift arm angle "θ" and/or tilt angle "ϕ" (see FIG. 2A) for work implement 38 during grading operations.

Controller 74 may include one or more processors 92 and/or one or more memory devices 94. Controller 74 may be configured to control operations of input devices 72, display devices 58, lift actuators 40, tilt actuators 42, cross-slope actuators 66, and/or other operations of machine 10. Processor 92 may embody a single or multiple microprocessors, digital signal processors (DSPs), etc. Numerous commercially available microprocessors can be configured to perform the functions of processor 92. Various other known circuits may be associated with processor 92, including power supply circuitry, signal-conditioning circuitry, and communication circuitry.

The one or more memory devices 94 may store, for example, one or more control routines or instructions for determining a position of work implement 38 relative to machine frame 12 or ground surface 26 and for controlling work tool assembly 16 based on the determined position. Memory device 94 may embody non-transitory computer-readable media, for example, Random Access Memory (RAM) devices, NOR or NAND flash memory devices, and Read Only Memory (ROM) devices, CD-ROMs, hard disks, floppy drives, optical media, solid state storage media, etc. Controller 74 may receive one or more input signals from the one or more input devices 72 and may execute the routines or instructions stored in the one or more memory devices 94 to generate and deliver one or more command signals to one or more of lift valves 86, tilt valves 88, and/or cross-slope valves 90 associated with lift actuators 40, tilt actuators 42, and cross-slope actuators 66, respectively.

One or more display devices 58 may be associated with controller 74 and may be configured to display data or information in cooperation with processor 92. In one exemplary embodiment, display device 58 may show the position of work implement 38 as x, y, z coordinates. In another exemplary embodiment, display device 58 may show lift, tilt, and/or cross-slope angles θ, ϕ, and/or φ (e.g. $\varphi_1$ and/or $\varphi_2$). In another exemplary embodiment, display device 58 may include a series of LED lights that indicate whether edge 56 of work implement 38 is above grade, on grade, or below grade. In one exemplary embodiment, instead of a visual display, controller 74 may be associated with an audible indicator configured to indicate whether edge 56 of work implement 38 is above grade, on grade, or below grade. In yet another exemplary embodiment, controller 74 may be associated with both display device 58 and the audible indicator. Display device 58 may be a cathode ray tube (CRT) monitor, a liquid crystal display (LCD), a light emitting diode (LED) display, a projector, a projection television set, a touchscreen display, or any other kind of display device known in the art.

Sensor 76 may be an inertial measurement unit disposed on at least one lift arm 36. In one exemplary embodiment, sensor 76 may be a six degree-of-freedom inertial measurement unit configured to generate a signal indicative of one or more of a position, inclination, acceleration, speed, etc. of lift arms 36 as lift arms 36 move in response to movements of lift actuators 40 and/or machine 10. For example, sensor 76 may generate a signal indicative of a position of lift arms 36 relative to either machine frame 12, ground surface 26, or gravity vector 96. In one exemplary embodiment, the signal from sensor 76 may be indicative of a height of work implement 38 or 64 above ground surface 26 or above machine frame 12. In another exemplary embodiment, sensor 76 may be an angle sensor configured to measure a lift arm angle θ of lift arms 36 relative to machine frame 12 or ground surface 26. In some exemplary embodiments, sensors 76 may be located adjacent loader joints 46, although it is contemplated that sensors 76 may be disposed anywhere on lift arms 36. It is also contemplated that in some exemplary embodiments, sensor 76 may be disposed on work implement 38, or on a coupler or other linkage mechanisms associated with lift arm 36 and work implement 38, the coupler or linkage mechanisms being configured to couple work implement 38 to lift arm 36.

Sensor 78 may also be an inertial measurement unit disposed on machine frame 12. Like sensor 76, in one exemplary embodiment, sensor 78 may be a six degree-of-freedom inertial measurement unit configured to generate a signal indicative of one or more of a position, inclination, acceleration, speed, etc. of machine frame 12. For example, sensor 78 may generate a signal indicative of a position of machine frame 12 relative to ground surface 26 or gravity vector 96. Sensor 80 may be an angle sensor configured to generate a signal indicative of tilt angle "ϕ" (see FIG. 2B) between work implement 38 and lift arm 36. Although exemplary sensors 76 and 78 have been described above as inertial measurement units having six degrees of freedom, it is contemplated that sensors 76 and 78 may be inertial measurement units having more than or less than six degrees of freedom. Further, although sensors 76 and 78 have been described above as inertial measurement units and sensor 80 as an angle sensor, it is contemplated that any of sensors 76, 78, and 80 may be positions sensors, rotary sensors, angle sensors, inertial measurement units, force sensors, acceleration sensors, speed or velocity sensors, or any other types of sensors known in the art. Sensors 76, 78, 80, and 82 may be in communication with controller 74 and may provide signals to controller 74 indicative of their respective sensed parameters. Additionally or alternatively, lift actuators 40, tilt actuators 42, and cross-slope actuators 66 may include in-cylinder or other position sensors that may be configured to measure an amount of extension or retraction of lift actuators 40, tilt actuators 42, and cross-slope actuators 66, respectively.

As also illustrated in the exemplary embodiment of FIG. 4, valve 86 may be a lift control valve, valve 88 may be a tilt control valve, and valve 90 may be a cross-slope or roll control valve. Valves, 86, 88, and 90 may control the extension and retraction of the lift, tilt, and cross-slope actuators 40, 42, and 66, respectively. Controller 74 may control valves, 86, 88, and 90 to adjust the flow of, for example, hydraulic fluid to control the rate and direction of movement of the associated lift, tilt, and cross-slope actuators 40, 42, and 66, respectively. Controller 74 may also be configured to determine the distance or amount of movement in one or more of the lift, tilt, or cross-slope actuators 40, 42, and 66 required to orient work implement 38 so that edge 56 of work implement 38 excavates ground surface to substantially generate the desired grade. Desired grade may include a desired mainfall and a desired cross-slope. In one exemplary embodiment, controller 74 may determine the distance or amount of movement in one or more of the lift, tilt, or cross-slope actuators 40, 42, and 66 based on trigonometric and/or kinematic equations, or based on a kinematic linkage based model of machine 10 stored in memory device 94. It is also contemplated that controller 74 may determine the distance or amount of movement in one or more of the lift, tilt, or cross-slope actuators 40, 42, and 66 based on look-up tables, flow charts, physical models, simulations, or other algorithms known in the art. It is further contemplated that one or more of lift, tilt, or cross-slope actuators 40, 42, and 66 may include sensors built into or mounted onto lift, tilt, or cross-slope actuators 40, 42, and 66, so that controller 74 may determine the distance or amount of movement in one or more of lift, tilt, or cross-slope actuators 40, 42, and 66 based on signals generated by the built-in or attached sensors.

Figure 5:
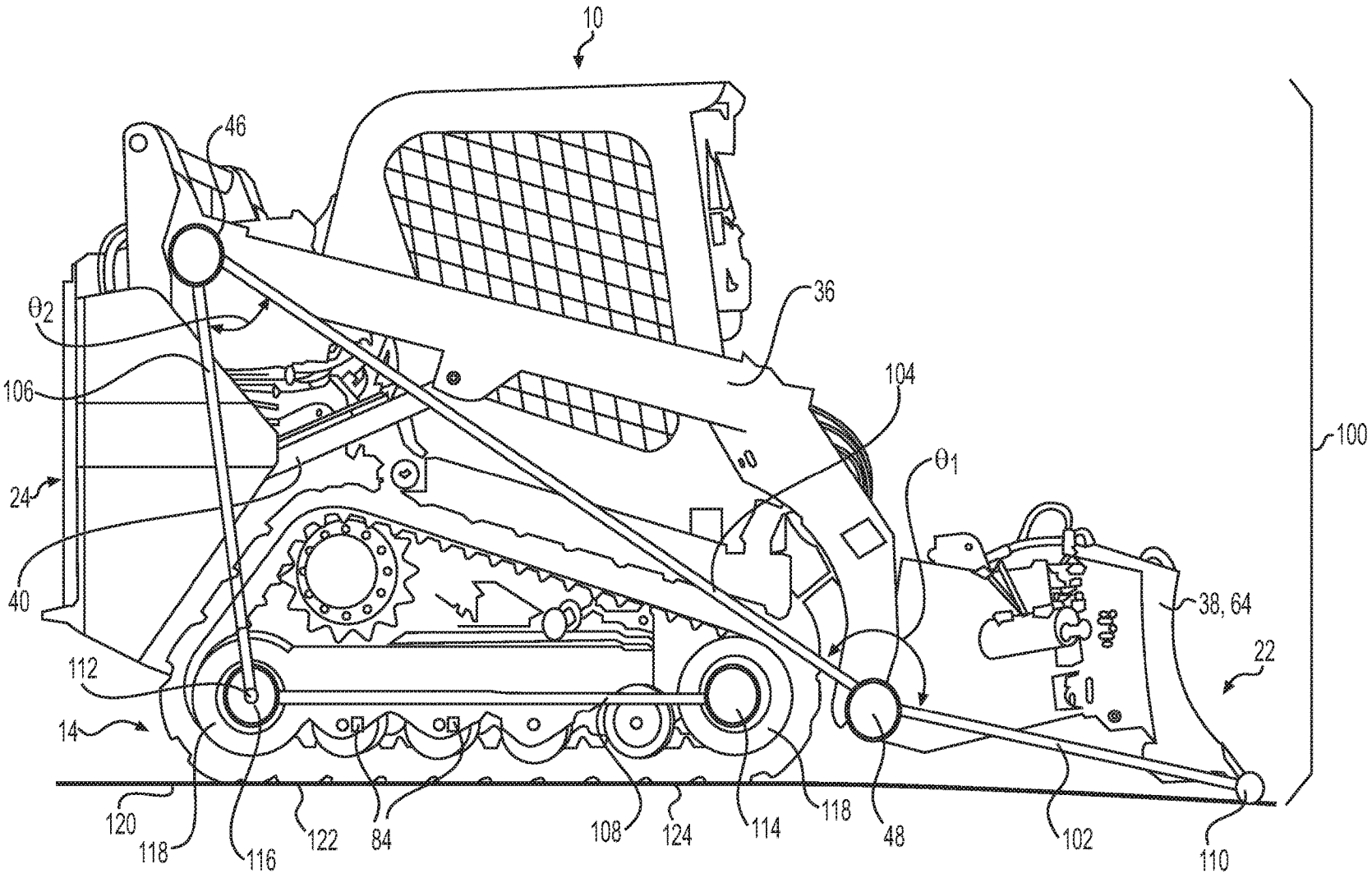
FIG. 5 is a pictorial illustration of an exemplary disclosed kinematic model of the machine of FIG. 1 or FIG. 3 that may be used by the grade control system of FIG. 4.

FIG. 5 illustrates a schematic corresponding to an exemplary disclosed kinematic model 100 for machine 10. As illustrated in FIG. 5, kinematic model 100 may include virtual linkages 102, 104, 106, and 108. Virtual linkage 102 may extend between tool joint 48 and at least one contact location 110 between edge 56 of work implement 38 and ground surface 26. Virtual linkage 102 may not represent bottom wall 54 of work implement 38 or any other structural member of machine 10. Rather virtual linkage 102 in kinematic model 100 may represent an approximation of working implement 38 or 64, pivotable about tool joint 48. Kinematic model 100 may also include virtual linkage 104 that may extend between loader joint 46 and tool joint 48. As discussed above, lift arms 36 may not be directly connected to machine frame 12 but instead may be connected to machine frame 12 via a linkage mechanism. Thus, virtual linkage 104 may not represent an actual structural member, for example, lift arm 36. Rather virtual linkage 104 in kinematic model 100 may represent an approximation of lift arm 36 and any associated linkage mechanism, allowing lift arm 36 to pivot about loader joint 46 and tool joint 48. Kinematic model 100 may also include virtual linkage 106 that may extend between loader joint 46 and a location 112. In one exemplary embodiment, location 112 may correspond to a rotational axis of one of idlers 118. It is contemplated, however, that location 112 may be located anywhere on machine frame 12 or undercarriage 14. Like virtual linkages 102 and 104, virtual linkage 106 may also not represent an approximation of machine frame 12. Kinematic model 100 may include virtual linkage 108 that may extend between ends 114 and 116. Virtual linkages 102, 104, 106, and 108 may represent a linkage mechanism that approximates the relative movements of one or more structural members forming machine frame 12 and work tool assembly 16.

In one exemplary embodiment, controller 74 may be configured to determine one or more of angle "$\theta_1$" between virtual linkage 104 and virtual linkage 106, angle "$\theta_2$" between virtual linkage 102 and virtual linkage 104, and/or angles $\varphi_1$ and/or $\varphi_2$ representing a cross-slope of work implement 38 based on kinematic model 100. Controller 74 may determine one or more of angles $\theta_1$, $\theta_2$, $\varphi_1$, and/or $\varphi_2$ to orient work implement 38 such that edge 56 may excavate ground surface 26 to generate a desired grade. Although FIG. 5 illustrates kinematic model 100 as having four virtual linkages 102, 104, 106, and 108, it is contemplated that kinematic model 100 for machine 10 may have any number of virtual linkages and any number of linkage connection locations, for example, loader joints 46, tool joints 48, locations 110, locations 112, and/or ends 114, 116.

INDUSTRIAL APPLICABILITY

The grading control system of the present disclosure may be used to continuously adjust an orientation of the work implement of a machine as the machine travels over a ground surface of a work site to perform grading operations. In particular, the grading system of the present disclosure may determine the orientation of the work implement based on a comparison of the desired grade to a plane defined by the contact points of the undercarriage of the machine and the ground surface. By doing so, the grading control system of the present disclosure may eliminate the need for external references, such as, grading stakes, laser planes, etc. for controlling the work implement during grading operations. The grading control system may also determine the configurations (e.g. extension or retraction) of various actuators, for example, lift, tilt, and cross-slope actuators, to orient the work implement according to the orientation determined by the grading control system to achieve the desired grade on the ground surface. An exemplary method of operation of grading control system 70 will be discussed below.

Figure 6:
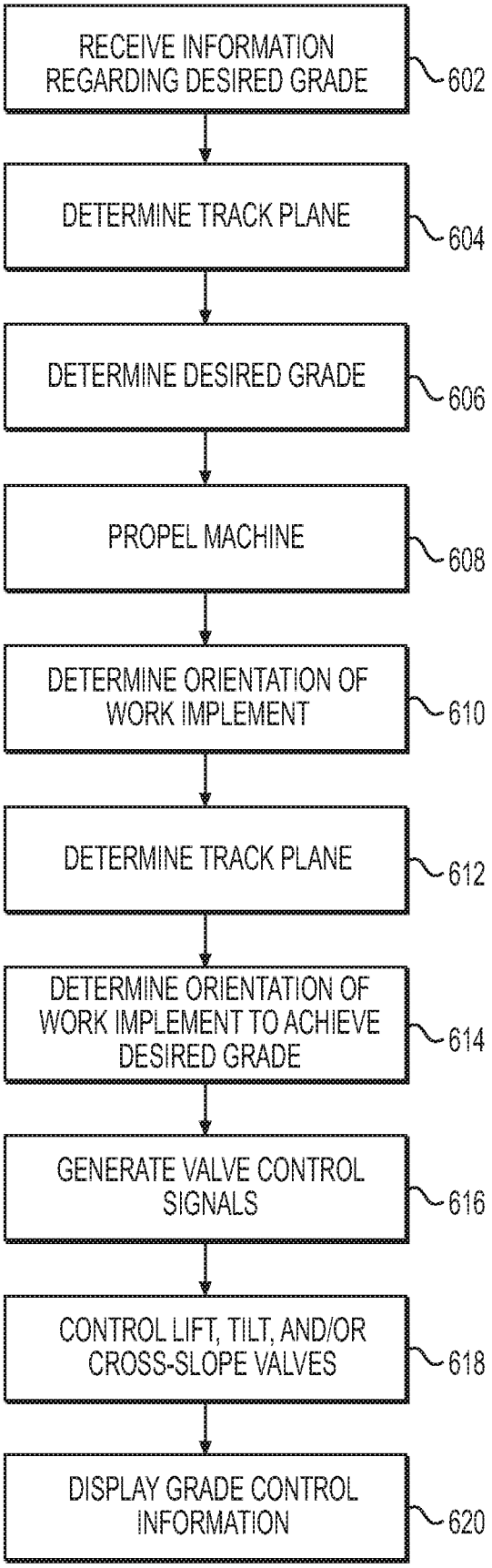
FIG. 6 is a flowchart illustrating an exemplary disclosed grade control method performed by the grade control system of FIG. 4.

FIG. 6 illustrates an exemplary grading control method 600 performed by grading control system 70 of machine 10. The order and arrangement of steps of method 600 is provided for purposes of illustration. As will be appreciated from this disclosure, modifications may be made to method 600 by, for example, adding, combining, removing, and/or rearranging the steps of method 600. Method 600 may be executed controller 74. Further, although the method is described below with reference to work implement 38, method 600 and its steps as described below and as illustrated in FIG. 6 are equally applicable to work implement 64.

Method 600 may include a step of receiving information regarding a desired grade for a worksite (Step 602). Information regarding the desired grade may be received, for example, via the one or more input devices 72 associated with machine 10. In one exemplary embodiment, the information may include a desired mainfall and/or a desired cross-slope. In another exemplary embodiment, the information may include an initial orientation of work implement 38. For example, the information may include a lift angle $\theta$, a tilt angle $\phi$, and or a cross-slope angle $\varphi$ (e.g. $\varphi_1$ or $\varphi_2$) associated with work implement 38.

Method 600 may include a step of determining a track plane 120 (see FIG. 5) of undercarriage 14 of machine 10 (Step 604). Track plane 120 may represent a plane corresponding to portions of ground surface 26 on which undercarriage 14 makes contact with ground surface 26. Thus, for example, track plane 120 may pass through portions of ground surface 26 in contact with tracks 28 and 30 of machine 10. In another exemplary embodiment, track plane 120 may pass through the portions of ground surface 26 in contact with the pair of front and/or rear wheels of machine 10. In some exemplary embodiments, controller 74 may determine track plane 120 by determining at least a pair of locations 122 and 124 at which undercarriage 14 may contact ground surface 26. In some exemplary embodiments, contact locations, for example, 122, 124, etc. may be identified based on sensors 84 (see FIG. 5) located in one or more rollers 32 of undercarriage 14. Controller 74 may determine track plane 120 by using mathematical expressions, algorithms, and/or instructions stored in memory device 94. For example, controller 74 may determine track plane 120 as a plane passing through contact points 122, 124, etc. based on a least-square method. It is contemplated that other regression techniques and/or algorithms may be used by controller 74 to identify track plane 120. In some exemplary embodiments, controller 74 may determine the track plane based on a current orientation of undercarriage 14, and a known geometry of machine 10. For example, controller 74 may determine an orientation of undercarriage 14 based on signals from the one or more sensors 76, 78, 80, and 82. Controller 74 may also determine the track plane as a plane corresponding to bottom-most locations of undercarriage 14. Controller 74 may determine the bottom-most locations as locations disposed at a maximum distance from machine frame 12 towards ground surface 26 based on a known geometry and/or kinematic model of machine 10.

Method 600 may include a step of determining the desired grade (Step 606). Controller 74 may determine the desired grade based on the information received in, for example, step 602. In one exemplary embodiment, controller may determine a plane defined by one or more of angles $\theta$, $\phi$, $\varphi_1$, and/or $\varphi_2$, and the known geometry of work implement 38 or edge 56. Controller 74 may then determine the desired grade (i.e. the desired mainfall and the desired cross-slope) based on an orientation of the plane relative to track plane 120 determined, for example, in step 604. In another exemplary embodiment, controller 74 may determine the desired mainfall and cross-slope based on a plane defined by one or more points on track plane 120 and one or more points on work implement 38 or edge 56, after orienting work implement 38 to the initial orientation specified by an operator or machine 10, for example, in step 602.

Method 600 may include a step of propelling machine 10 over ground surface 26 of a worksite (Step 608). Machine 10 may be propelled on ground surface 26 manually by an operator by using the one or more controls located in operator's station 20 of machine 10. Alternatively, machine 10 may be propelled on ground surface 26 automatically by controller 74, which may control one or more of a speed, acceleration, heading, and/or steering of machine 10 based on a predetermined travel path stored in memory device 94.

Method 600 may include a step of determining an orientation of work implement 38 (Step 610). Controller 74 may determine an orientation of work implement 38 by monitoring a height of work implement 38 above ground surface, a tilt position of work implement 38, and/or a cross-slope position work implement 38. Controller 74 may determine the height, lift position, and/or cross-slope position by determining a length of one or more of lift actuators 40, tilt actuators 42, and/or cross-slope actuators 66. Controller 74 may combine the determined lengths with geometric, trigonometric, and/or kinematic equations representing the geometry of machine 10 to determine the height, lift position, and/or cross-slope position of work implement 38.

Method 600 may include a step of determining track plane 120 of undercarriage 14 of machine 10 (Step 612). In step 612, controller 74 may perform one or more processes similar to those discussed above with respect to, for example, step 604. Method 600 may include a step of determining an orientation of work implement 38 to achieve the desired grade (i.e. the desired mainfall and the desired cross-slope) (Step 614). In step 614, controller 74 may compare the orientation of work implement 38 determined, for example, in step 610 with track plane 120 of undercarriage 14 of machine 10 determined, for example, in step 612. Controller 74 may determine the orientation of work implement 38 based on this comparison, and further based on, for example, one or more geometric, trigonometric, and/or kinematic equations, and/or kinematic models 100, or other algorithms stored in memory device 94. In one exemplary embodiment, controller 74 may determine angle $\theta_1$ between virtual linkages 104 and 106, angle $\theta_2$ between virtual linkages 102 and 104, and angles $\theta$, $\varphi_1$ and/or $\varphi_2$ for work implement 38 based on, for example, kinematic model 100 of machine 10. In other exemplary embodiments, controller 74 may determine lift angle $\theta$ and/or a tilt angle for work implement 38 based on angles $\theta_1$, $\theta_2$, and/or $\varphi_1$ or $\varphi_2$, or directly using kinematic model 100. In some exemplary embodiments, controller 74 may determine a tilt angle for work implement 38 required to orient work implement 38 relative to gravity vector 96 based on the orientation provided by an operator, for example, in step 602. In these exemplary embodiments, controller 74 may determine a lift angle $\theta$ required to maintain work implement 38 on a plane corresponding to the desired mainfall and the desired cross-slope as determined, for example, in step 606 based on, for example, one or more geometric, trigonometric, and/or kinematic equations, and/or kinematic models 100, or other algorithms stored in memory device 94. Controller 74 may determine the lift and tilt angles relative to track plane 120 of machine 10.

Method 600 may include a step of generating valve control signals corresponding to the determined new orientation of work implement 38 (Step 616). In step 616, controller 74 may generate control signals for one or more of valves 86, 88, 90 associated with one or more of lift actuators 40, tilt actuators 42, and/or cross-slope actuators 66, respectively. Method 600 may include a step of controlling one or more of lift, tilt, and/or cross-slope valves 86, 88, 90 to orient work implement 38 according to the determined orientation (Step 618). In step 618, controller 74 may adjust the flow of, for example, hydraulic fluid to or from one or more of lift actuators 40, tilt actuators 42, and/or cross-slope actuators 66 by controlling one or more of lift, tilt, and/or cross-slope valves 86, 88, 90 to orient work implement 38. In some exemplary embodiments, valve control signals generated by controller 74 for one or more of valves 86, 88, 90 may supplement signals generated for valves 86, 88, 90 based on one or more input devices 72, which may be operated by an operator of machine 10. In other exemplary embodiments lift actuators 40, tilt actuators 42, and cross-slope actuators 66 may be adjusted based solely on valve control signals generated by controller 74 in, for example, step 616.

Method 600 may include a step of displaying grade control information on display device 58 (Step 618). In step 618, controller 74 may display grade control information, including, for example, an actual grade of ground surface 26, a desired grade, an orientation of work implement 38, etc., on display device 58. In some embodiments, controller 74 may also display one or more LED lights to indicate whether edge 56 of work implement 38 is above the desired grade, on the desired grade, or below the desired grade. Controller may repeat one or more of steps 602 through 620 as machine 10 moves on ground surface 26 during grading operations.

As discussed above, grading control system 70 controls the orientation of work implement 38 based on a plane corresponding to undercarriage 14 of machine 10. By using the plane corresponding to undercarriage 14 of machine 10 as representative of the desired grade, grading control system 70 eliminates the need for external references, such as, grading stakes, laser planes, etc. Furthermore, by independently controlling one or more of lift actuators 40, tilt actuators 42, and/or cross-slope actuators 66, grading control system 70 allows edge 56 of working implement 38 or 64 to be oriented automatically to accurately adjust both the mainfall and the cross-slope, without input from the operator, during grading operations.

It will be apparent to those skilled in the art that various modifications and variations can be made to the disclosed grading control system. Other embodiments will be apparent to those skilled in the art from consideration of the specification and practice of the disclosed grading control system. It is intended that the specification and examples be considered as exemplary only, with a true scope being indicated by the following claims and their equivalents.

What is claimed is:

1. A grading control system for a machine, comprising:
a lift actuator configured to selectively raise and lower a work implement of the machine;
a tilt actuator configured to tilt the work implement;
a first sensor configured to communicate a first signal indicative of a first position of the work implement relative to at least one of a machine frame or a gravity vector;
a second sensor configured to communicate a second signal indicative of a second position of the machine frame relative to the gravity vector; and
a controller in communication with the first and second sensors and configured to:
determine a track plane defined by an undercarriage of the machine;
determine a desired grade relative to the track plane;
determine an orientation of the work implement relative to the track plane required to maintain the desired grade based on at least one of the first and second signals; and
generate at least one control signal to actuate at least one of the lift actuator and the tilt actuator to orient the work implement based on the determined orientation.

2. The grading control system of claim 1, further including a third sensor configured to communicate a third signal indicative of a cross-slope of the work implement, wherein the controller is further configured to determine the orientation of the work implement based on the third signal.

3. The grading control system of claim 2, wherein the controller is further configured to:
generate control signals corresponding to at least one of the lift actuator, the tilt actuator, and a cross-slope actuator; and
actuate the at least one of the lift actuator, the tilt actuator, and the cross-slope actuator based on the generated control signals.

4. The grading control system of claim 2, wherein
the first sensor is a first inertial measurement unit positioned on the work implement; and
the second sensor is a second inertial measurement unit positioned on the machine frame.

5. The grading control system of claim 2, wherein the third sensor is an angle sensor and the third signal is indicative of an angle between a lift arm and the work implement.

6. The grading control system of claim 1, wherein the controller is configured to determine the track plane based on at least two contact points between the undercarriage of the machine and a ground surface.

7. The grading control system of claim 1, wherein the machine includes:
a loader joint between a lift arm associated with the work implement and the machine frame; and
a tool joint between the work implement and the lift arm.

8. The grading control system of claim 7, wherein the controller is further configured to determine the orientation of the work implement based on a kinematic model of the machine.

9. The grading control system of claim 8, wherein the kinematic model includes:
a first virtual linkage extending between the tool joint and a ground surface;
a second virtual linkage extending between the loader joint and the tool joint; and
a third virtual linkage extending between the loader joint and an idler.

10. The grading control system of claim 9, wherein the controller is further configured to determine the orientation of the work implement by determining a first angle between the first virtual linkage and the second virtual linkage.

11. The grading control system of claim 10, wherein the controller is further configured to determine the orientation of the work implement by determining a second angle between the second virtual linkage and the third virtual linkage.

12. The grading control system of claim 11, wherein the controller is further configured to determine a cross-slope angle defining a cross-slope of the work implement.

13. A grading control method for a machine, the method comprising:
receiving at least one input indicative of a desired grade;
generating a track plane associated with the machine;
determining, using a controller, the desired grade relative to the track plane of the machine based on the at least one input;
propelling the machine on a ground surface;
determining, using the controller, an orientation of a work implement relative to the track plane required to maintain the desired grade as the machine is propelled on the ground surface;
generating, using the controller, at least one control signal to actuate at least one of a lift actuator and a tilt actuator of the machine based on the determined orientation; and
actuating at least one of the lift actuator and the tilt actuator based on the at least one control signal to orient the work implement.

14. The method of claim 13, wherein determining the track plane includes:
determining at least two contact locations between an undercarriage of the machine and the ground surface; and
determining the track plane based on the at least two contact locations.

15. The method of claim 14, wherein determining the orientation of the work implement includes:
defining a first virtual linkage between a tool joint and the ground surface, the tool joint being a pivotable connection between the work implement and a lift arm of the machine;
defining a second virtual linkage between the tool joint and a loader joint, the loader joint being a pivotable connection between the lift arm and a machine frame; and
defining a third virtual linkage between the loader joint and an idler.

16. The method of claim 15, wherein determining the orientation of the work implement further includes determining at least one of a first angle between the first and second virtual linkages, and a second angle between the second and third virtual linkages.

17. The method of claim 16, wherein determining the orientation of the work implement further includes determining a cross-slope angle defining a cross-slope of the work implement.

18. A machine, comprising:
a machine frame;
a plurality of traveling devices configured to support the machine frame over a ground surface;
a work implement;

a lift arm pivotably connected to the machine frame and to the work implement;

a lift actuator configured to selectively raise and lower the work implement relative to the machine frame;

a tilt actuator configured to tilt the work implement relative to the lift arm;

a first sensor configured to communicate a first signal indicative of a first position of the work implement relative to at least one of the lift arm, the machine frame, or a gravity vector;

a second sensor configured to communicate a second signal indicative of a second position of the machine frame relative to the gravity vector; and a controller in communication with the first and second sensors and with the lift and tilt actuators, and configured to:

determine a desired grade relative to a track plane associated with the travelling devices of the machine;

determine an orientation of the work implement relative to the track plane to maintain the desired grade based on at least one of the first and second signals;

generate at least one control signal to orient the work implement based on the determined orientation; and actuate at least one of the lift actuator and the tilt actuator based on the at least one control signal.

19. The machine of claim 18, further including at least one cross-slope actuator configured to tilt the work implement in a lateral direction wherein the controller is configured to determine the orientation of the work implement by determining at least one of a lift arm angle, a tilt angle, or a cross-slope angle.

20. The machine of claim 18, wherein the first and second sensors are inertial measurement units and the machine further includes at least one angle sensor configured to determine an angle between the lift arm and the work implement.

* * * * *